US007601906B2

(12) United States Patent
Craig et al.

(10) Patent No.: US 7,601,906 B2
(45) Date of Patent: Oct. 13, 2009

(54) METHODS AND SYSTEMS FOR AUTOMATED ANALYSIS OF MUSIC DISPLAY DATA FOR A MUSIC DISPLAY SYSTEM

(75) Inventors: Tim Craig, Georgetown, KY (US); Michael Craig, Frankfort, KY (US); Mark Craig, Georgetown, KY (US); Daniel Maggart, Georgetown, KY (US); Doug Anderson, Frankfort, KY (US)

(73) Assignee: Corevalus Systems, LLC, Georgetown, KY (US)

( * ) Notice: Subject to any disclaimer, the term of this patent is extended or adjusted under 35 U.S.C. 154(b) by 0 days.

(21) Appl. No.: 11/848,863

(22) Filed: Aug. 31, 2007

(65) Prior Publication Data

US 2008/0053294 A1 Mar. 6, 2008

Related U.S. Application Data

(60) Provisional application No. 60/824,154, filed on Aug. 31, 2006, provisional application No. 60/824,172, filed on Aug. 31, 2006, provisional application No. 60/824,180, filed on Aug. 31, 2006, provisional application No. 60/824,193, filed on Aug. 31, 2006, provisional application No. 60/824,190, filed on Aug. 31, 2006.

(51) Int. Cl.
*G10H 1/40* (2006.01)
*G10H 7/00* (2006.01)

(52) U.S. Cl. ..... 84/611

(58) Field of Classification Search ..... 84/611, 84/612, 609

See application file for complete search history.

(56) References Cited

U.S. PATENT DOCUMENTS

| | | | | |
|---|---|---|---|---|
| 6,307,139 | B1 * | 10/2001 | Iwamura | 84/601 |
| 6,582,235 | B1 * | 6/2003 | Tsai et al. | 434/307 A |
| 6,838,608 | B2 * | 1/2005 | Koike | 84/477 R |
| 7,094,960 | B2 * | 8/2006 | Ikeya et al. | 84/471 R |
| 7,199,299 | B2 * | 4/2007 | Asakura | 84/477 R |
| 7,220,909 | B2 * | 5/2007 | Funaki | 84/609 |
| 7,365,261 | B2 * | 4/2008 | Hirano | 84/600 |
| 2002/0134224 | A1 * | 9/2002 | Umezawa et al. | 89/1.1 |
| 2002/0194983 | A1 * | 12/2002 | Tanner | 84/478 |
| 2004/0112201 | A1 * | 6/2004 | Funaki | 84/477 R |
| 2006/0048632 | A1 * | 3/2006 | Morley et al. | 84/600 |
| 2006/0065100 | A1 * | 3/2006 | Funaki | 84/471 R |
| 2006/0185500 | A1 * | 8/2006 | Komano | 84/609 |
| 2008/0056491 | A1 * | 3/2008 | Craig et al. | 380/44 |

* cited by examiner

*Primary Examiner*—Jeffrey Donels
(74) *Attorney, Agent, or Firm*—Dinsmore & Shohl LLP

(57) ABSTRACT

Methods and systems for automated display of music data in a music display system. In one embodiment, a method for distinguishing lyrics and notations of a music data file is provided. In one embodiment, the lyrics are automatically shown in a different color or other display appearance relative to the notations. In another embodiment, the key of the notations is automatically determined and stored and/or displayed. In another embodiment, zoom in and zoom out capability is provided by automatically changing the font to appropriate permitted sizes, and/or by automatically determining the relative pixel spacing of the words in the lyric lines and the musical notation lines in the corresponding musical notation lines and selecting a font that maintains adequate spacing. Other inventive music display file presentation, storage, and analysis capabilities and features also are disclosed.

12 Claims, 15 Drawing Sheets

* WHERE N <= X, AND ANY IMAGE CAN BE SENT TO MULTIPLE SCREENS

* WHERE N <= X, AND ANY IMAGE CAN BE SENT TO MULTIPLE SCREENS

* WHERE N <= X, AND ANY IMAGE CAN BE SENT TO MULTIPLE SCREENS

RTF CHORD IDENTIFICATION

| CHORD TABLE | | |
|---|---|---|
| A | A# | Ab |
| B | B# | Bb |
| C | C# | Cb |
| D | D# | Db |
| E | E# | Eb |
| F | F# | Fb |
| G | G# | Gb |
| Maj | Min | 2nd |
| 7th | Sus | repeat |

FONT SIZE SELECTION

E A E ← 103
Provider, Supplier, Rewarder, Multiplier, ← 105

FIG. 14A

E A E ← 103
Provider, Supplier, Rewarder, Multiplier, ← 105

FIG. 14B

E A E ← 103
Provider, Supplier, Rewarder, Multiplier, ← 105

FIG. 14C

EXAMPLE OF STRING LENGTH MEASUREMENT:

CHORD LINE LENGTH
A D D G

LYRIC LINE LENGTH
THIS IS THE LORD'S DAY, I WILL REJOICE

FIG. 16

METHODS AND SYSTEMS FOR AUTOMATED ANALYSIS OF MUSIC DISPLAY DATA FOR A MUSIC DISPLAY SYSTEM

CROSS REFERENCE TO RELATED APPLICATIONS

This application claims priority from U.S. Provisional Patent Application Ser. No. 60/824,154 filed Aug. 31, 2006; U.S. Provisional Patent Application Ser. No. 60/824,172 filed Aug. 31, 2006; U.S. Provisional Patent Application Ser. No. 60/824,180 filed Aug. 31, 2006; U.S. Provisional Patent Application Ser. No. 60/824,193 filed Aug. 31, 2006; and U.S. Provisional Patent Application Ser. No. 60/824,190 filed Aug. 31, 2006. The entire disclosure of which are hereby incorporated by reference herein.

TECHNICAL FIELD

The present application relates generally to methods and systems for automated analysis of music display data for a music display system, and, more particularly some embodiments relate to methods and systems for detecting chords, lyrics, notes or keys from digital music display files, such that desired modification and/or display of the music for a music group can be achieved.

BACKGROUND

Some systems have been developed which are intended for display of music to members of a group. Such systems typically have a plurality of subsystems and a main controller which allows for the display of music on the subsystems, so the music can be sung and/or played by the members of the group.

Certain musical environments utilize particular digital file formats to store music to be displayed. However, conventional display systems lack the ability the adequately analyze the lyrics, chords, and notes in such files, as lyrics and notation are not distinguishable. While it is possible to analyze characteristics of such files manually, such a process can be time consuming and laborious. Conventional systems also lack the ability to automatically detect or modify certain features of the music file being displayed. Accordingly, it is desired in some embodiments to provide methods and systems for improved analysis and detection of music data in a music display file.

Additionally, such systems lack much flexibility in the way the music can be displayed, and lack the ability to display the music in a variety of manners. For example, conventional systems typically display images only and lack the ability to display or otherwise handle (e.g., analyze or store) chords or notes of the music in a manner different from the words of the music. Moreover, if a change in the display format is permitted, implementing the change might cause undesired changes to display of other parts of the file. For example, zooming in or out on the display, could cause undesired changes in the location of the corresponding notes or chords/notes relative to the words.

Accordingly, it is desired in some embodiments to provide methods and systems for improved display of music data in a music display system.

Moreover, one of the challenges with church music in particular is to select songs that flow together in the same key. Organizing and distributing song sheets and transposing keys if necessary can be very time consuming and burdensome, and many songs will not be selected for a given service because of this limitation. Also, modifying the key of a song on paper song sheets and distributing the sheets during a service is very difficult due to the time constraints involved in that process. Even just modifying the order of songs, or deleting or inserting a new song in to the scheduled list, can be very difficult with traditional methods because this entails redistributing and reorganizing the sheet music for each member of the music group. Accordingly, the songs to be played are rarely modified significantly during a given service. However, it can be desired to allow for flexibility in changing songs as a service progresses (based upon what occurs during the service), and even during a given song (to indicate a change in mood or the like). It is therefore desired in some embodiments to have flexibility in electronically displaying, distributing, analyzing, and/or modifying songs to be performed by a church group, and/or to be able to handle songs that may reside in various text files or other files. It is further desired in some embodiments to provide improved interfaces for display or editing of data in a music display file.

SUMMARY

In one embodiment, a method for detecting a musical characteristic of a music display file is provided. The method comprises accessing a music display file, wherein the music display file includes data representing lyrics and musical notation to be visually displayed to a user. The method further comprises analyzing sections of the data to determine which sections represent lyrics and which sections represent musical notation, and marking the lyrics and/or notation differently so as to distinguish one from the other (e.g., by changing the font or characteristic of the lyrics or notation, or by otherwise tagging the lyrics or chords). The display of the lyrics and the musical notation can then differ if desired in some embodiments. For example, the lyrics could be shown in a separate color, or the lyrics could be displayed by themselves on certain displays. Also, in other embodiments, knowing what text is musical notation can then allow that notation to be analyzed, such that musical characteristics such as key and the like can be automatically determined.

According to another embodiment, a system is provided which is configured to display musical data. The system comprises a controller configured to store a music display text file in memory, wherein the music display text file comprises text representing lyrics and text representing musical notation letters, and wherein the musical display text file includes an indication of the correspondence between each portion of musical notation letter text with each portion of lyric text. The system further comprises a display configured to receive the music display text file and to display each portion of musical notation text adjacent to the corresponding portion of musical letter text. In some embodiments, the notation text is displayed with a first appearance and the musical letter text is stored with a second appearance. In another embodiment, the system can include a set of stored instructions configured to be executed by a processor at the controller station and configured to analyze the musical display text file to determine which portions of the file are lyrics and which portions of the file are musical notation (e.g., chords). In another embodiment, the system can include a set of stored instructions configured to be executed by a processor at the controller and configured to analyze the musical display text file to determine musical characteristics of the file, such as the key for example. In another embodiment, the system can include a set of stored instructions configured to be executed by a processor at the controller station and configured to cause the system to receive input commands for adjusting the zoom level of the displayed musical display text file, and configured to automatically adjust the fonts of the lyric text the musical notation text to maintain appropriate relative display of the musical notation text and the lyric text.

According to another embodiment, a method for detecting a musical characteristic of a music display file, comprising accessing a music display digital file, wherein the music display digital file includes data representing at least one of lyrics and musical notation to be visually displayed to a user. The method further comprises analyzing sections of the data to determine a musical characteristic of the music display digital file, and storing and/or displaying the musical characteristic along with at least one of lyrics and musical notation.

According to another embodiment, a method for changing the display appearance of a music display file is provided comprising receiving a command to change the display of music display data, and determining an appropriate display appearance for the music display data based upon the command received. The method further comprises displaying the music display data in the appropriate display appearance. In some embodiments, the command comprises a zoom command, the display appearance comprises a font, and the determination comprises determining an appropriate font for musical lyrics and musical notations based upon the command by using font sizes suitable for the lyrics and notations and the command received.

BRIEF DESCRIPTION OF THE DRAWINGS

While the specification concludes with claims particularly pointing out and distinctly claiming the present inventions, it is believed the same will be better understood from the following description taken in conjunction with the accompanying drawings in which:

FIG. 14 depicts exemplary portions of digital music display files, with FIG. 14C showing how the font can automatically be increased to an acceptable size when the user wishes to zoom in, and yet proper correspondence is maintained between chords/notes and lyrics of the file according to some aspects of the present inventions;

FIG. 16 is an example of the measuring of a string of text and musical notation, according to additional aspects of the present inventions.

Figure 1:
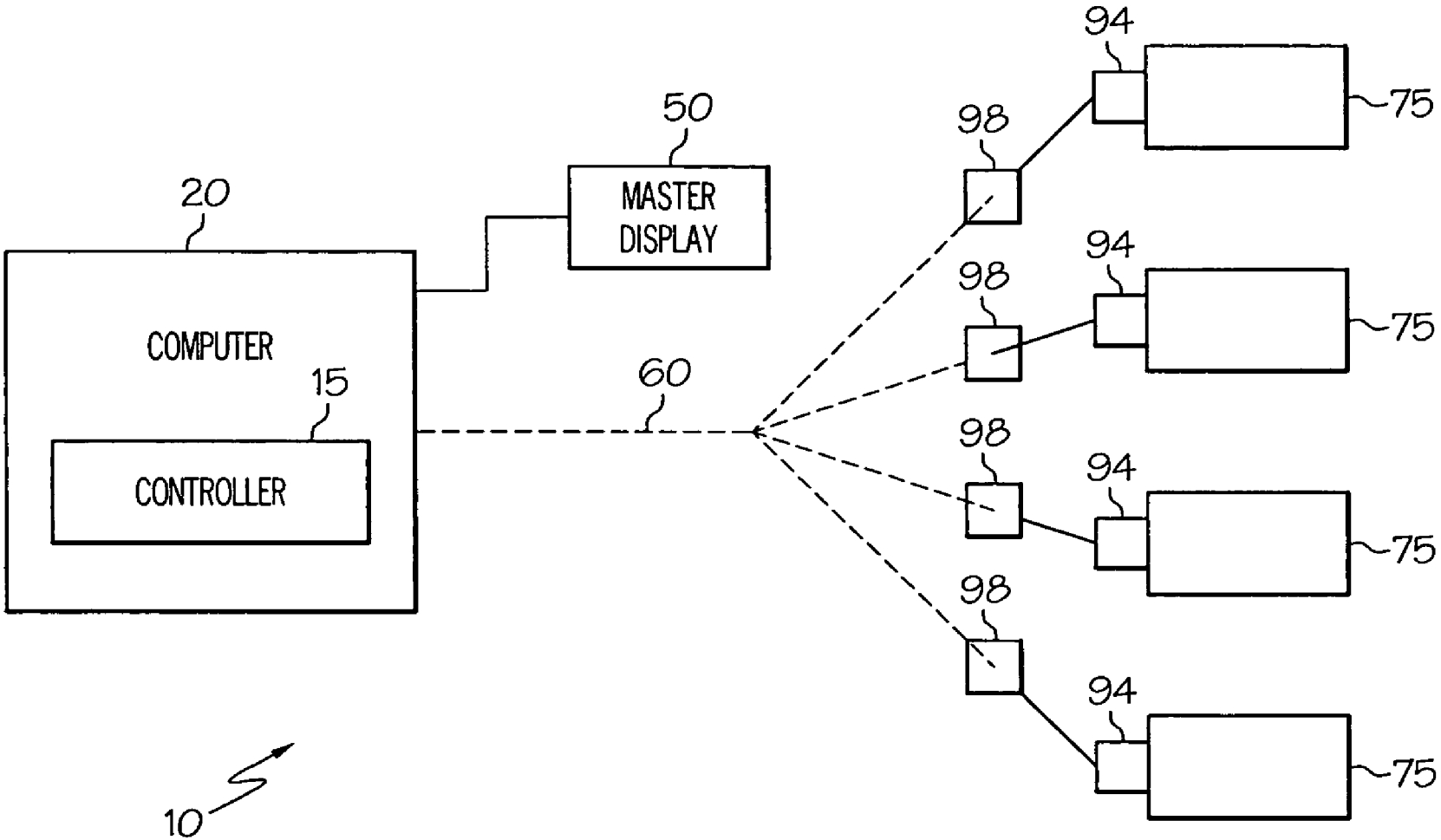
FIG. 1 is a schematic illustration of an example of a multi-display system according to one aspect of the present inventions.

The embodiments set forth in the drawings are illustrative and exemplary in nature and not intended to be limiting of the inventions defined by the claims. Moreover, the individual features of the drawings will be more fully apparent and understood in view of the detailed description.

DETAILED DESCRIPTION OF EXAMPLE EMBODIMENTS

Reference will now be made in detail to various embodiments which are illustrated in the accompanying drawings, wherein like numerals indicate similar elements throughout the views.

Figure 7B:
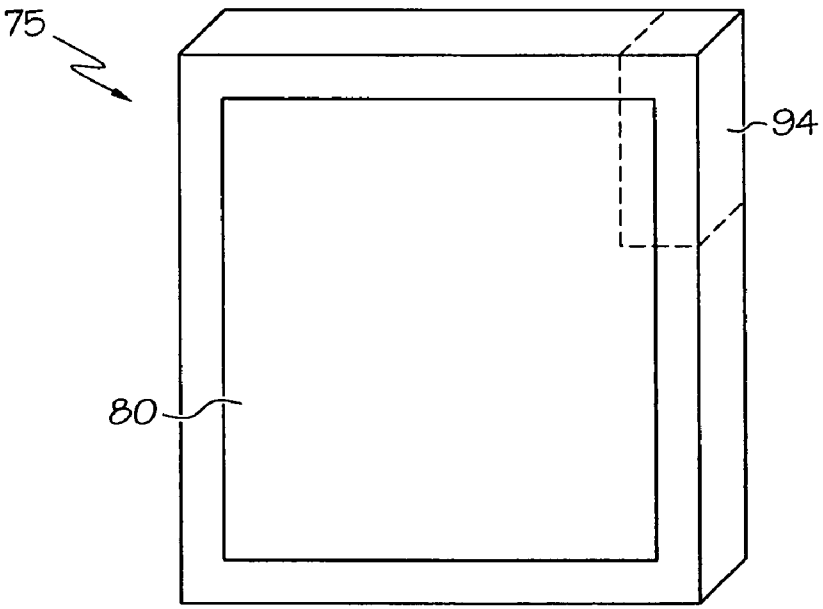
FIGS. 7A and 7B are schematic illustrations of exemplary music displays according to other aspects of the present inventions.
Figure 7A:
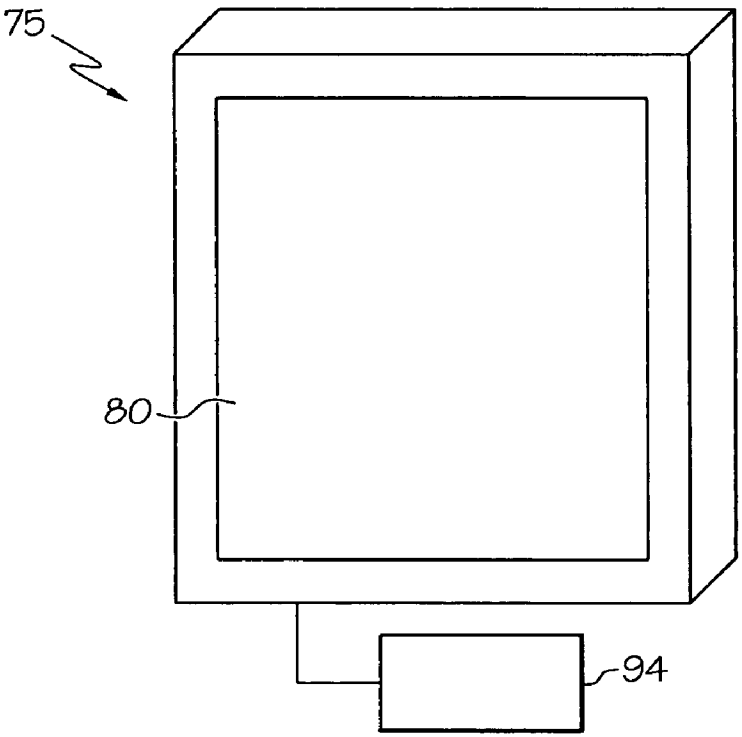

One embodiment where various aspects of the present inventions can be utilized is illustrated in FIG. 1. The multi-display system 10 comprises a computer 20, a master display 50 and one or more remote displays 75 in communication with the computer 20 through a communication link 60. In one exemplary embodiment, the communication link 60 is a wired connection, such as Ethernet, Firewire, fiberoptic, USB cable, and the like. In an alternative embodiment, the communication link 60 is a wireless technology such as Wi-Fi, cellular, Bluetooth, RF, IR, and the like. The computer 20 comprises a controller in communication with the one or more remote displays 75 and the primary display 50. In one exemplary embodiment, the controller 15 executes a screen shot generator, wherein the screen generator is adapted to create an image file, and wherein the image file comprises an image corresponding to a desired screen display. The image file can be in any of the following formats or other suitable data format: jpg, bmp, gif, tiff, pcs, and the like. This image file is then transmitted from the computer 20 to the remote display 75. The image file is converted to the appropriate communication standard by a video adapter, as shown at block 94 in FIG. 1. In one exemplary embodiment, as illustrated in FIG. 7A, the video adapter 94 is external from the remote display 75. In an alternative embodiment, the video adapter 94 is integral to the remote display 75. The remote displays 75 are configured to be able to receive the image file from the computer 20 and to the display this corresponding image for the image file. In particular, the displays 75 may include a network connector, shown at block 98 in FIG. 2, which is configured to receive the signal from the computer 20 and to convert the signal into an appropriate format for use by the display 75, such as one of the following formats or other suitable format: vga, dvi, xvga, and the like. In this embodiment, the computer 20 is not required to have additional video display cards for remote displays 75.

Figure 2:
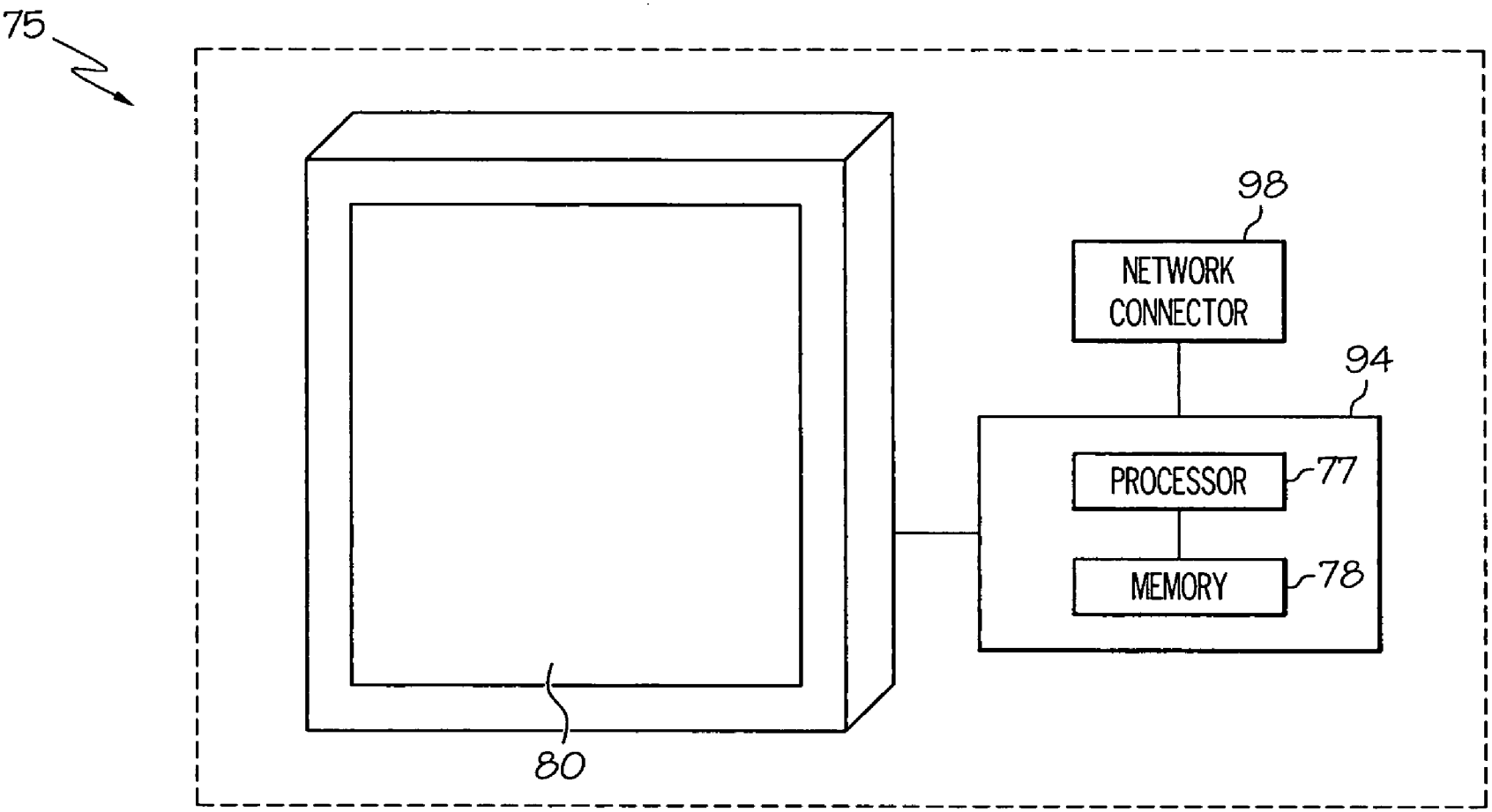
FIG. 2 is a schematic illustration of an example of a remote display according to another aspect of the present inventions.

In one exemplary embodiment, as depicted in FIG. 2, the one or more remote displays 75 comprise a processor 77 in communication with the display 80 and the network connector 98. In an alternative embodiment the video adapter 94 may further comprise the processor 77. The processor 77 is configured to execute software on an operating system 10 to convert video data of the image files into a VGA signal. In an alternative embodiment, a separate video adapter or controller is utilized to convert video data of the image files into a VGA signal for the remote displays. In another embodiment, the remote image display 75 further comprises a computer-readable memory storage unit 78 in communication with the processor 77. The memory storage unit 78 provides storage for the software to convert the video data into VGA signals, and in one alternative embodiment, the memory storage unit may store image files transmitted from the controller 15 of the computer 20. In another exemplary embodiment, the controller 15 of computer 20 "pushes" the remote image file to the one or more remote displays. In an alternate exemplary embodiment, the processor 77 of the remote display 75 "pulls" the remote image file to the remote display 75 from the computer 20. In an alternate embodiment, the software comprises a web browser wherein the web browser is configured to request a file from a predetermined web-server. The web-server can be populated with image files to be displayed on the remote displays 75.

In another embodiment, remote displays 75 are provided, wherein the remote display 75 comprise the ability to display image files without the need of additional video cards on the server computer. In this embodiment, each of the remote displays 75 has an address. One or more static image files are generated by the controller 15 of the main computer 20. The static image files generated correspond to the desired display output presented to a user on one or more of the remote displays 75. A static image file is typically a file containing a discrete set of data which can be in a variety of formats such as jpg, gif, pcx, pdf, and the like as opposed to a conventional video which contains streaming video data or video signals. The controller 15 then determines which of the remote displays 75 to transmit the one or more static image files to. After determining which display to transmit the remote image file to, the controller determines the address of the desired remote displays 75 for the image file to be transmitted. The controller 15 then transmits one or more static image files to the corresponding addresses for the one or more remote displays 75, depending on which displays/persons require the given image. For example, in a music display system for a band, choir, or other music group, certain singers or musicians may need a particular music sheet, while others may need another version of that music sheet. In a further embodiment, the one or more remote displays 75 receive the image file and a processor 77 (attached to or part of the display) executes the image file to create a visual display on the display 75. In one exemplary embodiment, the image file is immediately executed and displayed on the display 75, whereas in an alternative embodiment, the image file is stored in the memory 78 of the remote display 75 until a predetermined time or signal is generated and transmitted from the computer 20 to the remote display to execute on the processor 77 the commands to display the image on the remote display 75.

The system can operate a method for displaying one or more images on multiple remote displays. The method can comprise selecting an image to be displayed on one or more remote displays; generating a remote image file corresponding to the selected image; and transmitting the remote image file to the one or more remote displays, wherein the one or more remote displays are configured such as to display an image corresponding to the remote image file. In one embodiment, the remote image file is transmitted to the one or more remote displays in response to request for the remote image file from the one or more remote displays. In yet another embodiment, the method further can comprise generating a synchronization timing file, wherein the synchronization timing file comprises a set of instructions for displaying one or more remote image files in a predetermined order. The synchronization file can be transmitted to the remote image display, and the synchronization timing file requests one or more remote image files to be displayed on the one or more remote displays. The synchronization timing file can comprise a list of web pages or files to be loaded into the web browser or display software at predetermined times, and can be executed by the main controller 15, wherein the main controller 15 transmits the remote image files at a predetermined time to the one or more remote displays. Multiple remote image files can be transmitted to a storage device located at or near the one or more remote displays. Such storage device may comprise a computer readable memory such as flash memory or hard drive storage devices.

The remote image file can be regenerated and retransmitted to the one or more remote displays at a predetermined refresh rate. Exemplary refresh rates range from several times per second to once per minute. One exemplary refresh rate is from about 1 to about 2 seconds per screen refresh. In one exemplary webpage embodiment, the refresh rate can be programmed into the webpage.

In some embodiments, each of the remote displays is assigned an address. The address can comprise an IP address, wherein each of the one or more remote displays has a unique IP address. In another embodiment, the system stores the addresses in an address storage table. The address storage table can then be utilized by the controller to transmit image files to a specific address corresponding to one or more remote displays. In some systems, the remote displays can be addressed by a subset name such as section names or instrument part names. For example, one or more remote displays could be labeled "Sopranos", "Altos", "Tenors" and "Basses". Alternatively, the displays could be labeled "guitar 1", "guitar 2", "flutes", "trumpets", "bass", etc. The label for these displays would then be associated with addresses for those displays, with particular outputs from the computer, or with particular signal types or identifiers. An image that is to be transmitted to the "Basses" for example, can then be transmitted by selecting the group name "Basses", which then causes the single image file to be converted to the appropriate format and output using the appropriate addresses, outputs, or signals to the appropriate displays. Rather than sending individual streaming video signals to each of the displays and the required video display adapters required to generate such video signal, this embodiment sends a single static image file to the desired group of displays.

In another exemplary embodiment of the present invention, the system comprises a control station and multiple thin client units in communication with the control station. The control station may comprise a personal computer or other networked device in communication with multiple thin client units. A thin client is a network computer typically without a hard disk drive, which, in client/server applications, is designed to be especially small so that the bulk of the data processing occurs on the server. However, in an alternative embodiment, the thin client handles the bulk of the data processing.

In one exemplary embodiment, the system comprises a system of networked computing systems, for example a primary personal computer (control station) and one or more multiple thin clients (secondary units), wherein the primary personal computer coordinates music for all of the thin clients.

In one embodiment, the primary unit (control station) networks and links to a group of secondary units. In this embodiment, the primary unit has functionality which includes at least one of the following: the ability to download a list of songs including the song content to one or more secondary units; the ability to select the type/part of music (e/g. trumpet part, piano part, etc.) and send the music content for the selected type for the list of songs to one or more secondary units; the ability to synchronize the list of songs to be displayed on the secondary units; the ability to select the play order of the songs of the playlist in the secondary units; the ability to send commands to select the 'now playing' song for the secondary units; the ability to send user defined messages to individual secondary units, groups of secondary units or all of the secondary units; the ability to edit one or more pages of a particular song and send edited page to one or more designated secondary units, such edits include annotations and revised pages, etc.; the ability to receive annotations and other edits from a secondary unit and there store edited/annotated page in database; the ability to synchronize and display a timing devise (e.g. metronome) or sound an audio output on each or selected ones of the secondary units, as well as the ability to maintain such synchronization.

In another embodiment, the secondary units have one or more of the following functionality; the ability to operate in a networked environment or in a "stand-alone" mode; the ability to allow a user to annotate/edit/mark-up pages of music using a user input interface such as a keyboard and mouse device; the ability to allow the user to change the song or displayed page using an input device; the ability to change the song or displayed page on other secondary units displaying the same content as primary unit; and the ability to send user defined messages to the control station and/or other secondary units.

One embodiment of the system allows for generating a graphic user interface, whereas the graphic user interface is configured to allow a user, such as the director or conductor, to select one or more remote displays to receive the remote image file. In one exemplary embodiment, the graphical user interface comprises a representation of each remote image file being displayed on a corresponding remote display.

In some embodiments, the remote image file can comprise a screen shot or static image of the image to be displayed, or an HTML or XML file comprising one or more screen displays.

In some embodiments, the system 10 is embodied in a music display system. The music display system is configured to display music for a team of musicians or singers, such as in a church music team environment. In a church music team environment for example, a church may have hundreds of songs to select from for a particular service. In a service a subset of songs may be selected to be played. In addition, it may be desirable to occasionally change one or more of the songs, or to change the order of the songs to be played. In a traditional music performance setting using paper sheets of music, it may be impossible to play a song that was not originally selected as the order of songs for the service due to the fact that music may not be distributed to each of the team members. In addition, changing the order of the music can also be difficult as the musician is typically using their hands for their instrument which limits their ability to swap the order of the music on their stand. Other times, it may be desirous to change the keys to the song. Many church worship leaders either limit their song selection to the same key or transpose the key to the song by hand and make copies for the team. In the present inventions, the change in the music can be quickly sent to the one or more remote displays.

Figure 3:
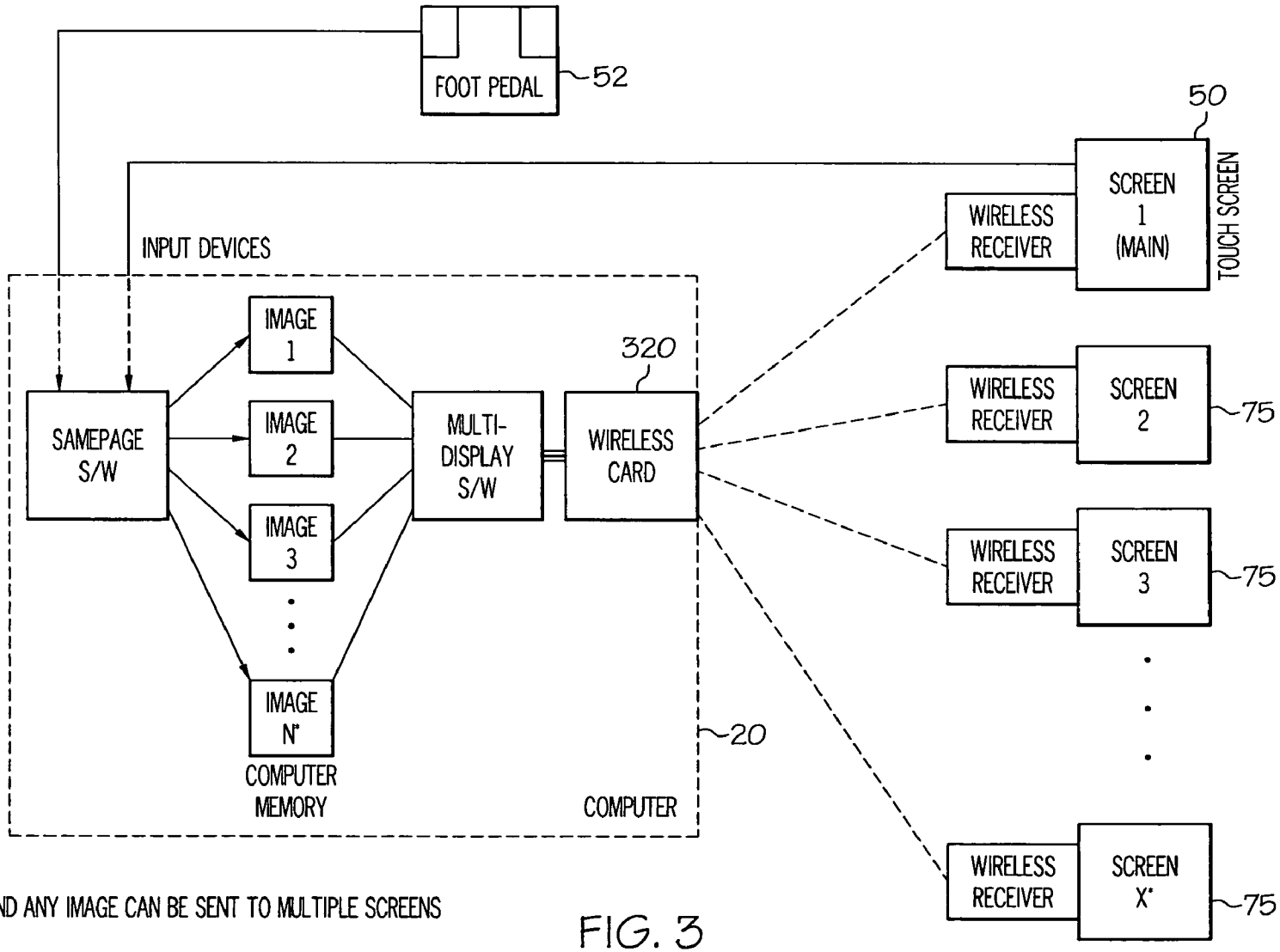
FIG. 3 is an schematic illustration of an example of a music display and management system with multiple displays controlled by a single computer via a splitting device, according to additional aspects of the present inventions.
Figure 4:
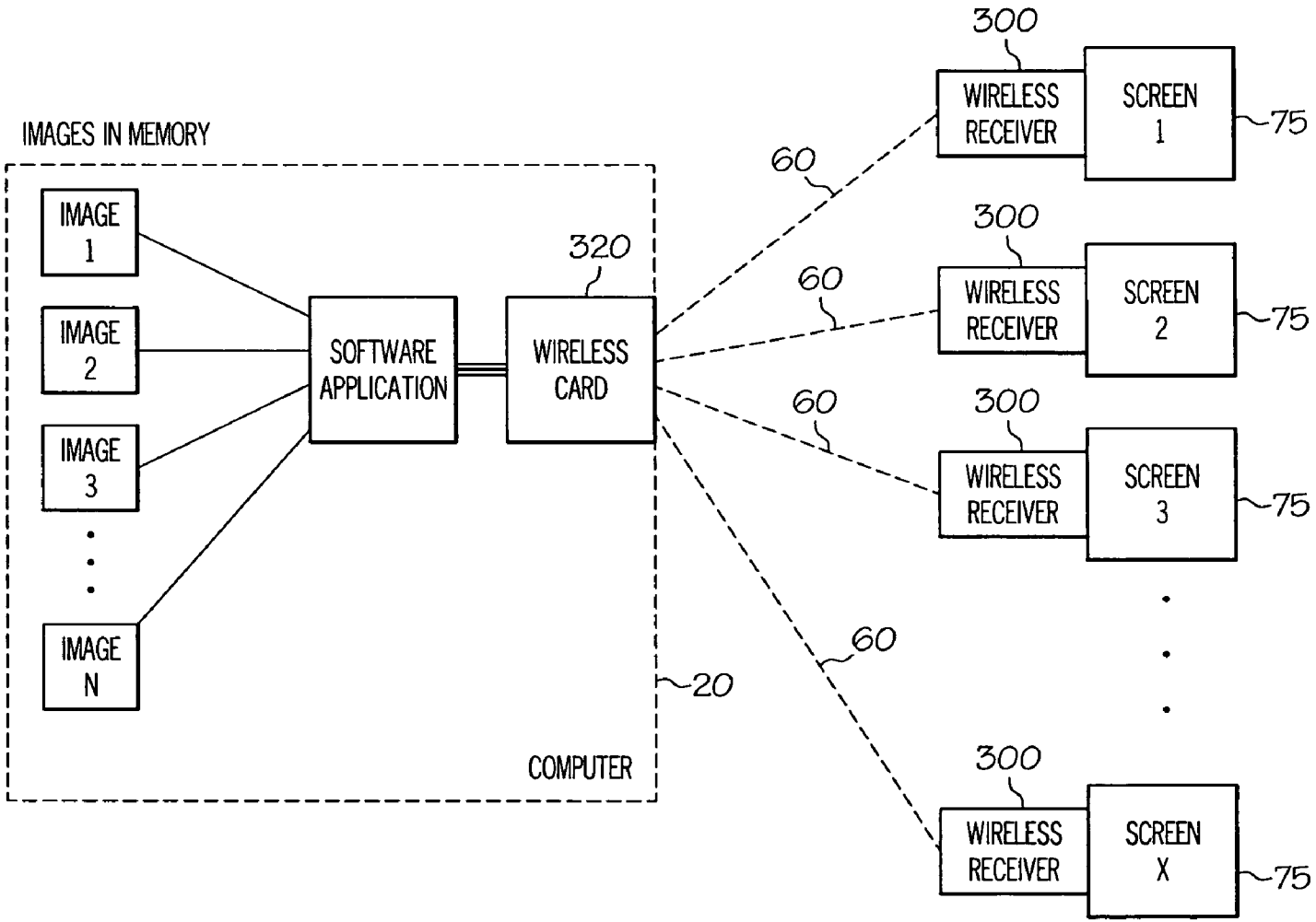
FIG. 4 is a schematic illustration of an example of a music display and management system with multiple displays controlled by a single computer, each display having a wireless receiver to receive the same music image and provide the display to different musicians/singers, according to additional aspects of the present inventions.

The music display system of this embodiment, illustrated in FIG. 3, comprises a master display 50, one or more input devices 52, and one or more remote displays 75. In one exemplary embodiment, the master display 50 comprises a touch screen display. The touch screen display may comprise a computer itself or be in communication with a computer 20. The touch screen is intended to be used by the music team leader for song selection, song order, song key, display format, and other features. The one or more input devices 52, such as a foot pedal or a hand wireless remote, are used to input user input into the system. Each of the remote displays are connected to the main computer via a wireless or wired connection. In the particular embodiment illustrated in FIG. 3, each of the remote displays are connected to a network, wherein the computer 20 is connected to the same network. In one exemplary embodiment, each of the one or more remote displays are in communication with a video display adapter device such as a processor and graphics adapter and the like. Such video display adapters may comprise personal computers, laptops and the like. In an alternative embodiment, the remote display is configured to connect to a network and has the ability to generate video display signals.

In one exemplary embodiment, each of the remote displays 75 comprises a communications processing device. In this embodiment, the controller connects to the multiple remote displays and is able to send various display modes (images of sheet music) of the same song to various monitors. The communications processing device comprises a communication link and adapter card. For example, the communications processing device comprises an Ethernet card or a wireless network adapter card.

One embodiment of the present inventions is a method of transmitting images saved in memory to various remote monitors or displays. These images can comprise image files. Alternatively, the image files could be actual video memory for the video display adapter of the remote display. In one exemplary embodiment, the images can be saved in memory as files. In one exemplary embodiment, the graphical user interfaces include logic to allow the user to select which static image files are sent to which remote monitors or displays. One static image file can be sent to multiple wireless monitors.

The system can include a user interface that allows the various images to be named (for example, keyboard, vocals, guitar, flute, etc.) and allows the various displays to be named (for example, keyboard, vocals, guitar, flute, etc.). In one exemplary embodiment, the graphic user interface is configured to allow for the user to select which images are to be displayed on each of the remote displays.

Figure 5:
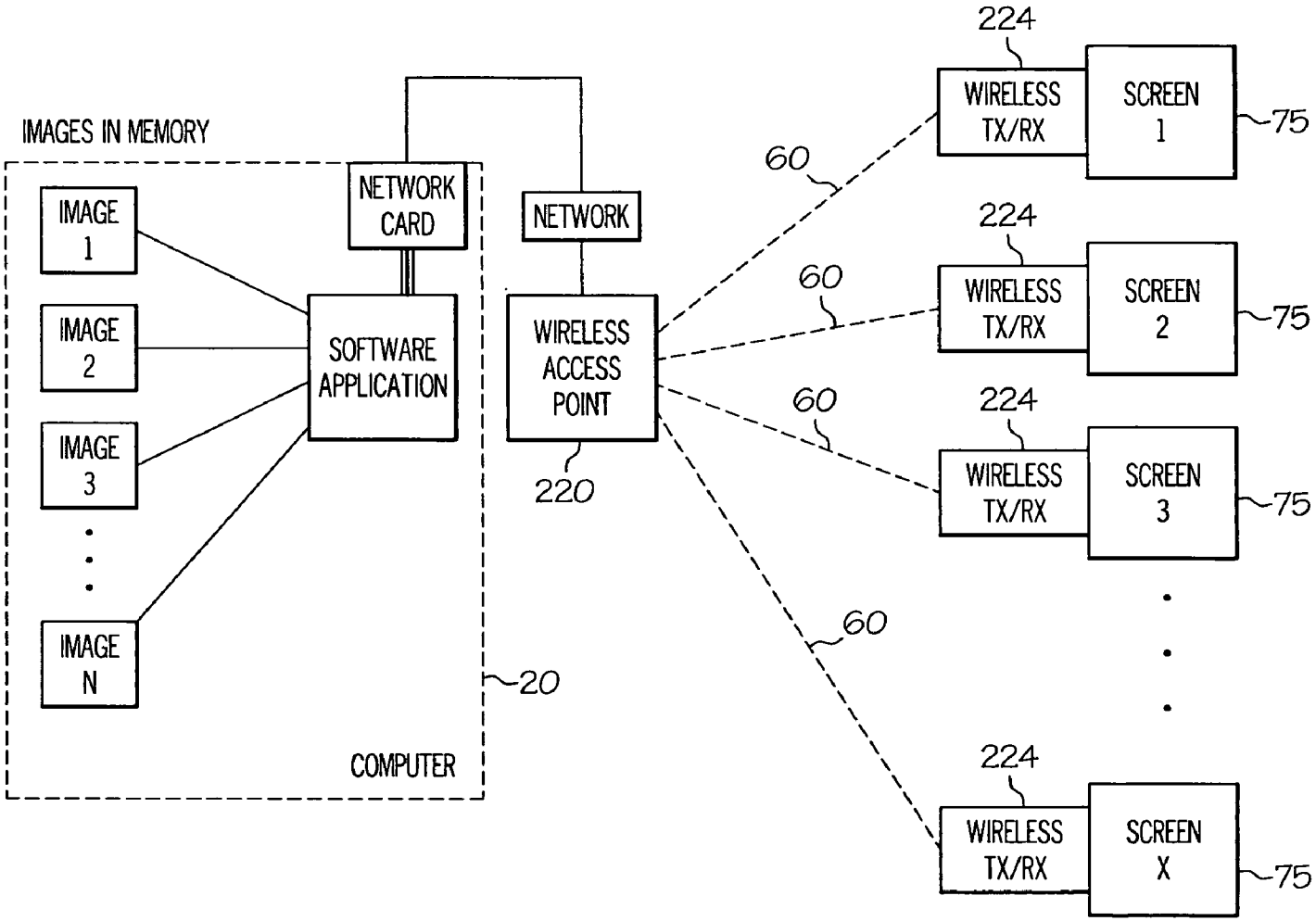
FIG. 5 is a schematic illustration of an example of a music display and management system with multiple displays controlled by a single computer, each display having a network connection to receive the same music image and provide the display to different musicians/singers, according to additional aspects of the present inventions.

FIG. 5 illustrates a communication link that can be utilized. The link 60 comprises one or more various IEEE 802.11 wireless communications protocol. Typically a wireless access point or router 220 will transmit the signals carrying the static image files to a wireless access card 224 connected to the remote display 75 or external video display adapter (not shown). If this communication protocol were utilized, the image file can be converted into a 2.4 GHz or 5 GHz radio frequency signal and encoded onto the signal using complementary code keying (CCK) coding wherein it can transmit 11 megabits of data per second or orthogonal frequency division multiplexing wherein it can transmit up to 54 megabits of data per second. It is possible in another embodiment for the computer to connect to a network via landline or other and network communication devices such as wired or wireless hub, router, or other technology known to one skilled in the art.

The one or more remote displays can comprise a wireless receiver 300 in communication with a wireless transmitter 320 in communication with the computer 20. In a further embodiment, the one or more remote displays comprise touch screens, configured to allow a remote user to communicate to another user of the music display system by touching the screen and composing a message. The message can be predefined. In an alternative embodiment, a keypad is displayed upon the display and is configured to allow the user to enter a message. In yet another exemplary embodiment of the present inventions, a primary user, such as a director, is able to select the output for the remote displays via a master display and input device.

In some embodiments, a screen shot generator program can be configured to create multiple static image files of music song sheets in memory. The controller then selects and sends the images to one or more remote displays. The one or more remote displays may further comprise an input device. The input device can be utilized by a remote user to send a signal to the controller 20 to retransmit and/or regenerate the remote image file. For example, in the music embodiment, the remote user may desire a different instrumentation or vocal piece of the music, and/or the music in a different key. This music file can be generated by the controller and then retransmitted to the remote display.

Figure 6:
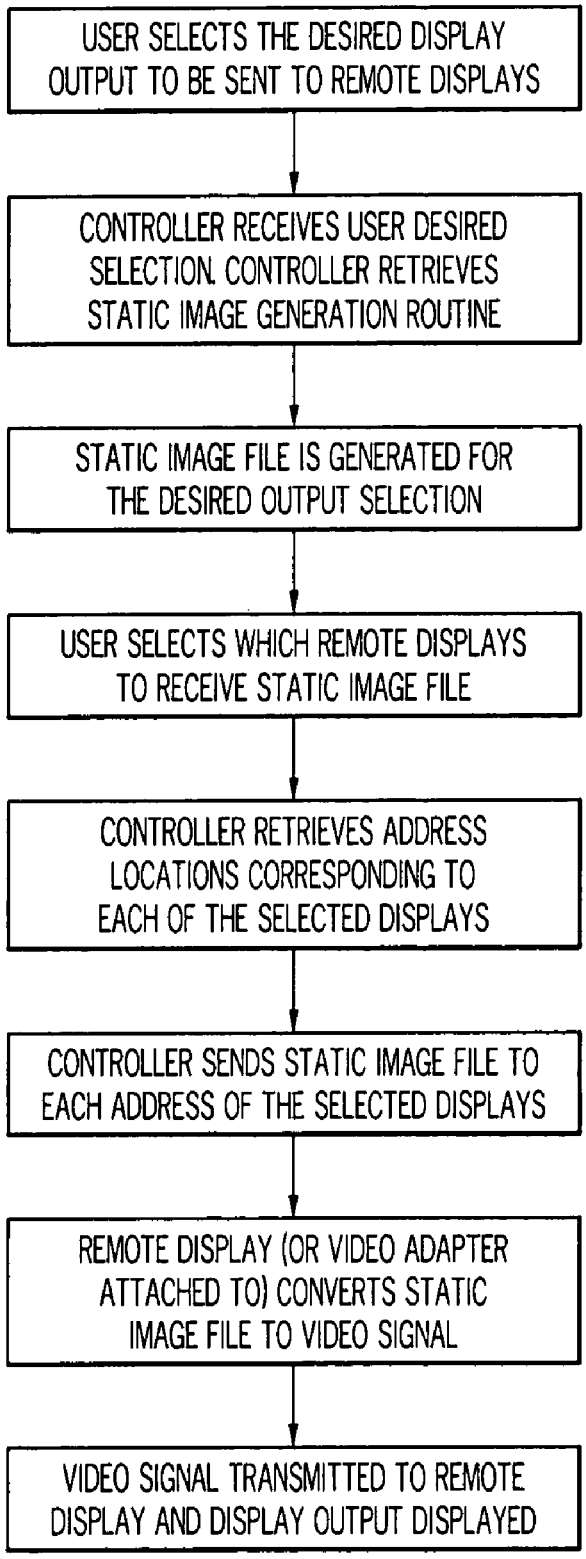
FIG. 6 is a flow chart illustrating an exemplary method for encoding and transmitting a single music file image and providing that image to multiple displays, according to an additional aspect of the present inventions.

Another embodiment of the present inventions, illustrated in FIG. 6, is a method for displaying one or more static images on multiple remote displays. This method comprises providing one or more remote displays 75, wherein the remote display 75 comprise the ability to display image files without the need of additional video cards on the server computer. In this embodiment, each of the remote displays 75 has an address. One or more static image files are generated by the controller 15 of the main computer 20. The static image files generated correspond to the desired display output presented to a user on one or more of the remote displays 75. A static image file is typically a file containing a discrete set of data which can be in a variety of formats such as jpg, gif, pcx, pdf, and the like as opposed to a convention video file which contains streaming video data. The controller 15 then determines which of the remote displays 75 to transmit the one or more static image files to. After determining which display to transmit the remote image file to, the controller determines the address of the desired remote displays 75 for the image file to be transmitted. The controller 15 then transmits one or more static image files to the corresponding addresses for the one or more remote displays 75, depending on which displays/persons require the given image. For example, in a music display system for a band, choir, or other music group, certain singers or musicians may need a particular music sheet, while others may need another version of that music sheet. In a further embodiment, the one or more remote displays 75 receive the image file and a processor 77 (attached to or part of the display) executes the image file to create a visual display on the display 75. In one exemplary embodiment, the image file is immediately executed and displayed on the display 75, whereas in an alternative embodiment, the image file is stored in the memory 78 of the remote display 75 until a predetermined time or signal is generated and transmitted from the computer 20 to the remote display to execute on the processor 77 the commands to display the image on the remote display 75.

Figure 8:
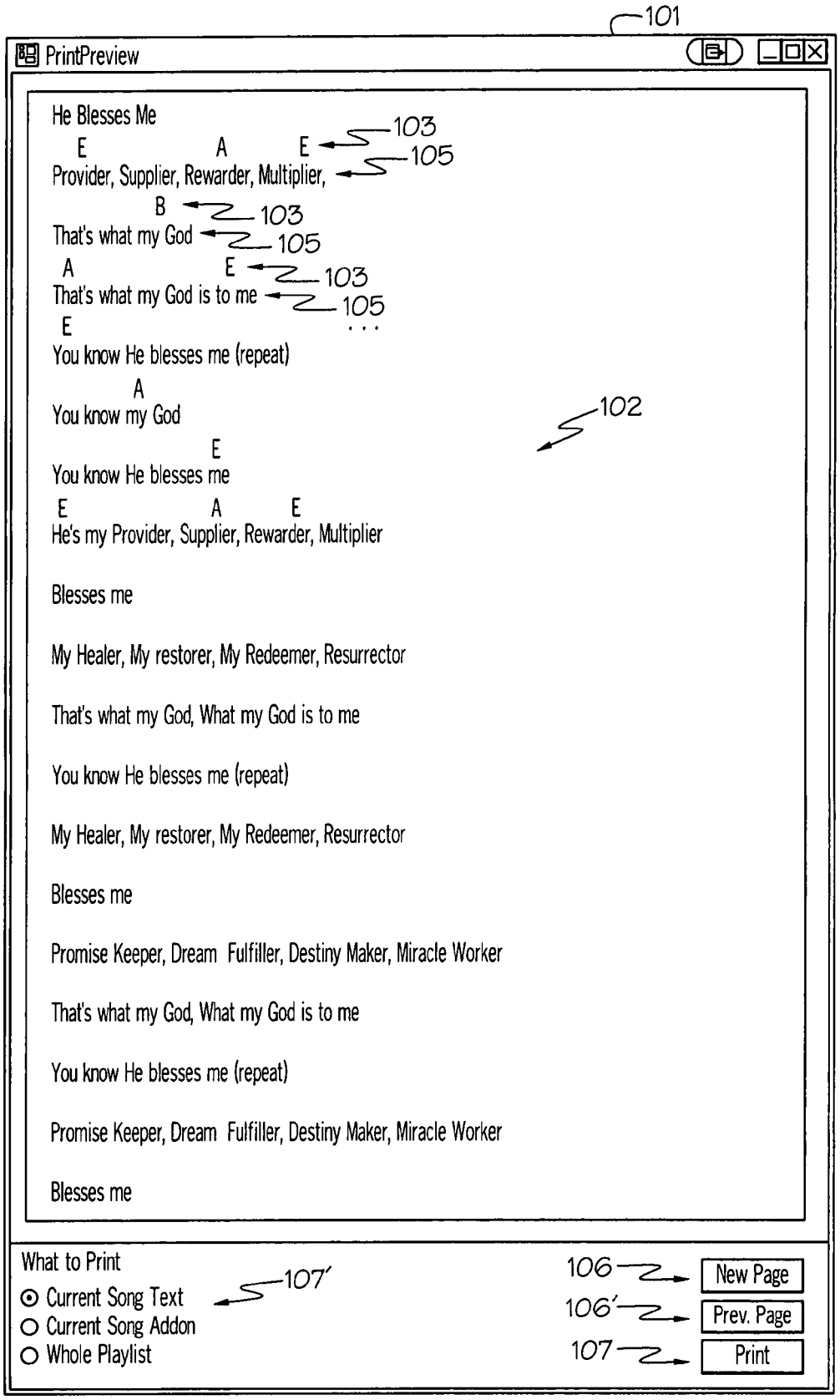
FIG. 8 is an exemplary user interface for display of the contents of a music text file, with lyrics and chords shown above the lyrics, according to additional aspects of the present inventions.

FIG. 8 is an exemplary user interface for display of the contents of a music text file, with lyrics and chords shown above the lyrics, according to aspects of the present inventions. (Here the interface is shown in a print preview mode, although the same information can be displayed in other modes, such as editing mode, normal mode, reading mode, or web mode). In this embodiment, the music display file is a text file and is shown as text 102 on a display screen. Such text 102 can be displayed to each member of the music group. The text 102 can be stored digitally in any of a variety of formats, such as document file formats, word processing formats (e.g., .doc formats), HTML formats, plain text formats, or Rich Text Formats, for example. In this embodiment, the digital data represents lines of chords 103 and lines of lyrics or words 105. (The chords 103 could also be notes, or other musical notations, in some embodiments). The lines 103 reflect how the music is to be played or sung, while the lines 105 reflect the accompanying words of the music. In this embodiment, the digital music file 102 is displayed in a graphical user interface 101, which can comprise a screen or display, or a window or frame on the screen or display. The user interface 101 can include buttons or controls 106/106' for scrolling through the music file, as well as buttons 107/107' for commanding the device to print the song, portions of the song, or a series of songs in a playlist. Accordingly, the embodiment of FIG. 8 allows for the display and manipulation of a digital music display file for display to one or more users (such as users in a music group for example).

Figure 9:
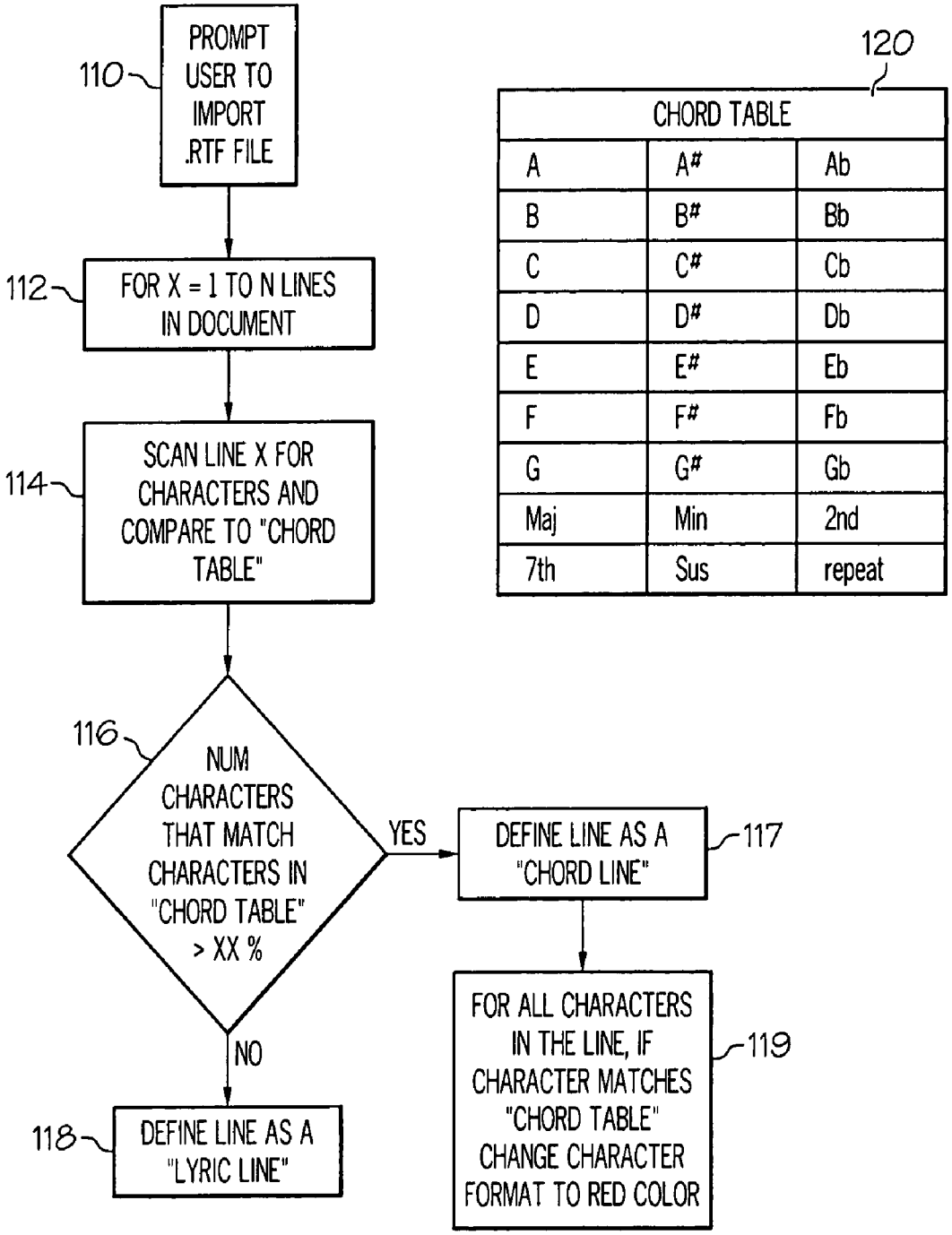
FIG. 9 is a flow diagram illustrating an example of a process for automatically identifying chords from a digital music display file, according to aspects of the present inventions.

FIG. 9 is a flow diagram illustrating an example of a process for automatically identifying chords from a digital music display file, according to additional aspects of the present inventions. The process can be embodied in code or instructions or a program (or portion thereof), which is executed by a computer, processor, controller or similar circuitry. In this example, the process starts at block 110 where it prompts the user to import the desired music display file. In this example, the file is in RTF format. The process then conducts a check of the lines of the file, in an executed loop, as shown at block 112. The process examines each line in the file and scans each line for characters which would most closely match those in a table 120 stored in memory. This operation is shown at block 114 of FIG. 9. A tally is kept of the total number of characters in the line that match characters in the chord table 120, and that tally is compared to a predetermined number or level, as shown at block 116. If the tally exceeds the predetermined level, then the process proceeds to operation 117 to define the line as a "chord line." If the tally does not exceed the level, then the process proceeds to operation 118 where the line is defined as a "lyric line." Accordingly, the process can automatically differentiate lyrics from chords (or other musical notations) of a digital music display file stored in a document format. The process can then differentiate chord lines from lyric lines and can then analyze and/or display the two separately and/or distinctly. For example, if the line is defined as a chord line, the characters in that line can be compared to the array of available chords (or notes). For the characters that match a chord or note, the font for that character (or other characteristic of the text or surrounding area, such as boldness, background color, text color, highlighting, italicizing, etc.) can be changed such that it stands out on the display separately from the lyrics. (The chords or lyrics can be otherwise marked or tagged in other manners alternatively, such as via the way they are stored, the way they are tagged, their characteristics, and/or data that precedes or follows the chord or lyric data). As shown at operation 119 of this example, the chord characters can be changed to red color font format for example to indicate recognition. As another example, knowing the difference between chords and lyrics, the system/process can proceed with other analysis on the file. For example, the chord lines can be analyzed for certain musical features or characteristics (key, timing, etc.) and those characteristics can be determined and/or displayed. Alternatively, for certain displays it may be desired to only display the lyrics (e.g., to the displays of the congregation), while for other displays it may be desired to display both chords and lyrics (the displays of the guitar players). As another option, the lyrics can be split out into one electronic file while the chords can be split out into another. Accordingly, the lyric files could be displayed to certain displays or sent to the congregational display system (e.g., those of the congregation) and the chords and lyrics could be displayed to other displays (those of the musicians). This process thus allows for flexibility in the way a music display file is displayed and can provide this flexibility automatically. It can also allow for the determination and/or display of additional information relative to the music display file.

Figure 10:
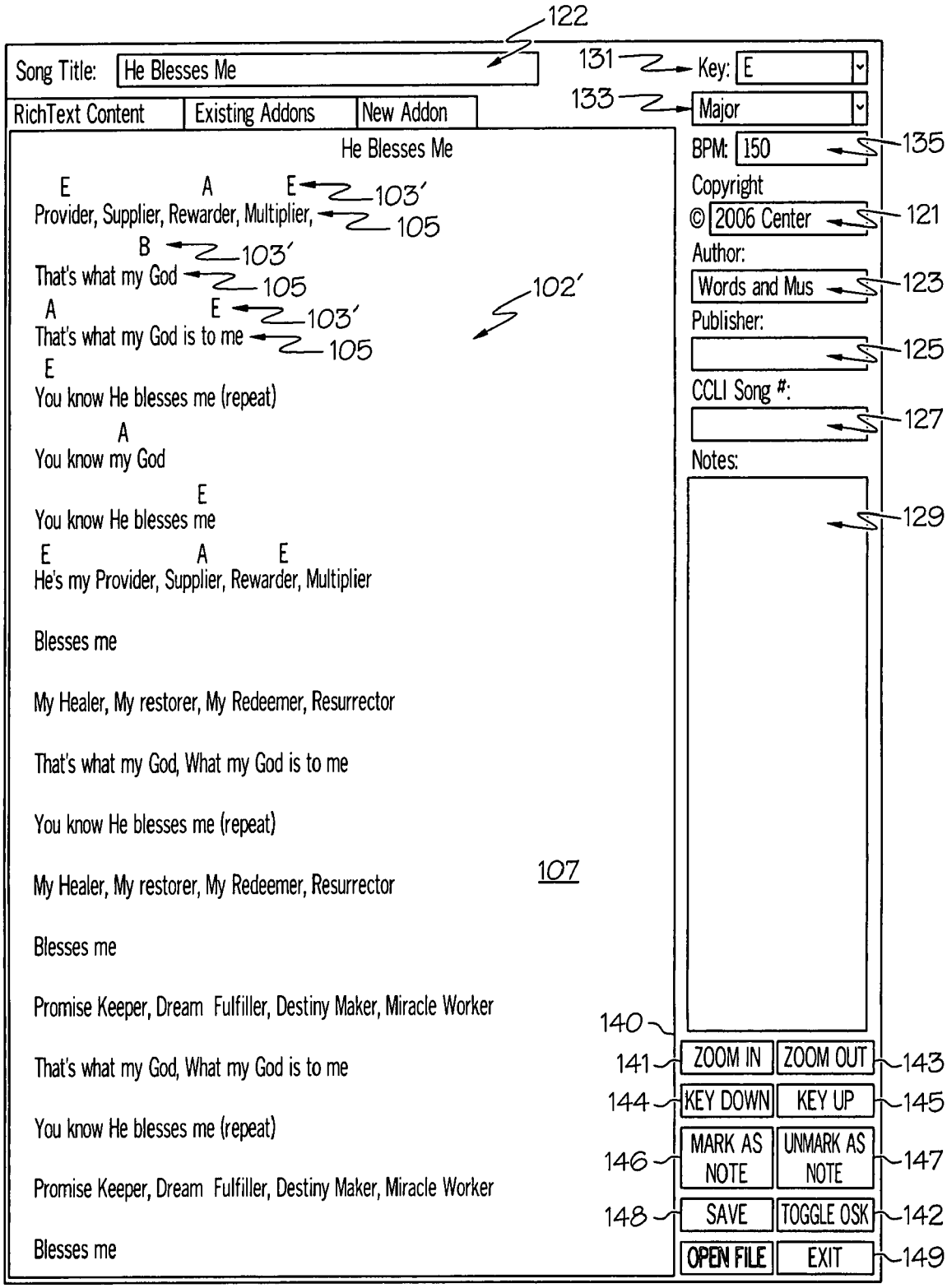
FIG. 10 is another exemplary user interface for display of the contents of a music text file, with the lyrics and chords shown distinctly such as through use of colors, and with ability to display and/or modify the key or other characteristic of the music, according to additional aspects of the present inventions.

FIG. 10 is another exemplary user interface for display of the contents of a music text file, with the lyrics and chords shown distinctly such as through use of colors, and with ability to display and/or modify the key or other characteristic of the music, according to additional aspects of the present inventions. In this example, the displayed file 102' shows the chord lines 103' in a separate color from the lyric lines 105. Because the chords and the lyrics have been differentiated electronically, the two lines can be displayed differently. For example, the chords in the lines 103' can be displayed in red (indicated as light grey in the attached drawing), while the actual lyrics can be displayed in another color (e.g., indicated as black). Thus, the chords can stand out from the lyrics. According to one aspect of the present inventions, the digital music display file can be stored or marked with an indication of which groups of the data represent chords/notes, and which represent lyrics or text. For example, a flag can be set for each line that is a chord. Alternatively, the font of the chords can be set differently from the lyrics, as mentioned above.

FIG. 10 also indicates that a variety of information can be retrieved, analyzed, entered and/or displayed, the information being from or related to the music display file. For example, at boxes 121, 123, 125, 127, and 129, general information about the music can be displayed, such as its copyright data, author, publisher, CCLI number, and associated notes (description of the song, genre, volume or album from which it originates). Information regarding the musical content can also be displayed. For example, the key of the music can be displayed at 131, whether the key is major or minor is shown at block 133, and the number of beats per minute is shown at block 135. According to aspects of the present inventions, this information can be stored with the digital music display file or determined from that file. As will be described in further detail below, the determination can occur automatically according to some aspects of the present inventions—for example, the key can be determined automatically from the data representing the chord lines 103'. Other information can also be displayed, such as the title 122. This information can be manually entered for a given song, as the boxes 121-135 comprise data entry boxes. Accordingly, the user can create a music text file using the example interface of FIG. 10, according to some aspects of the present inventions. Here, the user could enter the key, BPM, copyright data, author, publisher, and title using the boxes and then also enter the text and notations of the song using the editor box 107. Accordingly, this embodiment allows for the creation of songs that can be stored in text format (e.g., RTF, .doc, etc.) once entered. For songs already created, when the user selects the song the system can automatically populate the boxes and editor box 107 with the data from the song, and changes can then be made to the information, lyrics, and/or chords. Accordingly, the example of FIG. 10 also allows for editing of text data representing a song, according to additional aspects of the present inventions.

A control box or area 140 is also provided in this inventive embodiment. Controls 141 and 143 can control the display of the music, for zooming in and zooming out purposes and the like. According to aspects of the present inventions, one or more key modification controls 143 and 144 can be provided for changing the key of the song. Here, the key can be modified upwardly by pressing the key up button 145 and the key can be modified downwardly by pressing the key down button 144. Such buttons can initiate a key modification algorithm which changes the data of the chord lines 103' and/or of the key box 131, such that they are shown in a separate key. In such embodiments, the algorithm can scan the data, determine the chord lines (such as via the process above), and then modify each chord in the line such that it is reflected in the new key. To perform this task, a stored table or instructions can match each chord with the next chord up in a key change and the new chord down in a key change—the appropriate chords can then be chosen based upon the current chord and the command (key up or key down). This capability allows for changes in keys offline or during realtime (e.g., during a church service). This allows the worship leader to add songs into a playlist that are originally in different keys and then change them to the same key. It also can be used to step or step down the key of the song on the fly as it is being played, to change the mood of the song. Due to the electronic displays, the team members can realize this change immediately and can have the adjusted musical notation in front of them immediately. In some embodiments, it may be desired to show the key change to only certain members of the group (e.g., those playing certain instruments). Accordingly, when the key change is made, it can be transmitted to certain appropriate displays, such as by addressing those displays only and transmitting the modified data to those displays only.

Additional capability can also be provided. For example, in this embodiment, certain letters or portions of text can be marked as a note, such that they are displayed differently. In particular, the mark as note button 146 can be utilized to mark the selected letters or text as a note (which might then automatically cause a change in the font of the selection such that is shows up differently and/or is stored with data marking it as a note (e.g., data representing a particular font for that character, the font being a predetermined font representing notes)). Conversely, to change text from appearing as a note (or chord) to appearing as plain text (or lyric), the button 147 can be utilized. This could cause the reverse operation to occur (the text is changed from being in the chord/note font to being in the lyric/text font). Other buttons can also be provided, such as to save the changes to the song (using button 148), to exit the program (using the button 149), to make an on-screen keyboard appear (using the toggle OSK button 142) so inputs can be provided via a touchscreen rather than a separate keyboard, or to copy, paste, delete, or the like.

Figure 11:
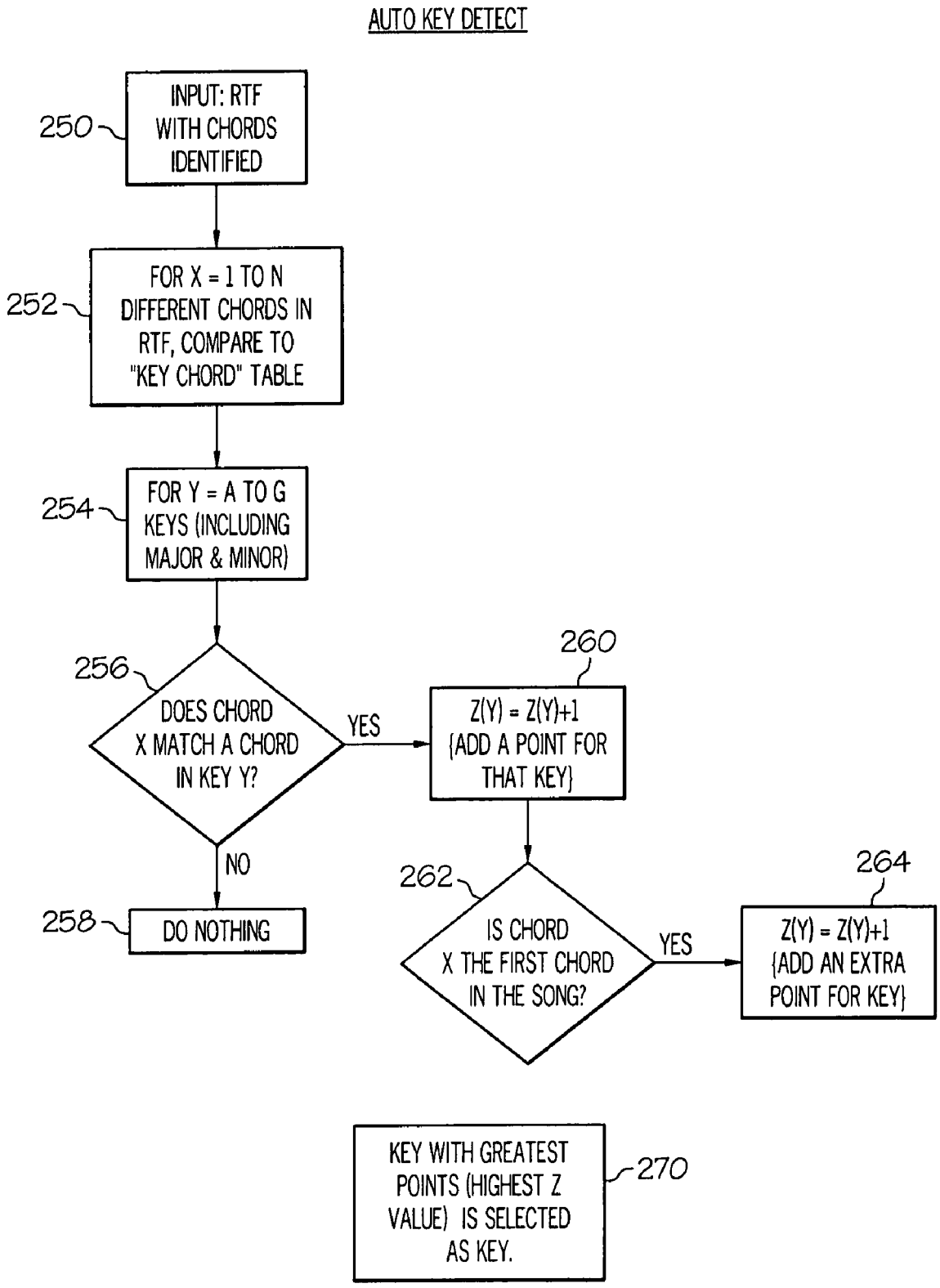
FIG. 11 is a flow diagram illustrating an example of a process for automatically identifying the key from a given digital music display file, according to aspects of the present inventions.

FIG. 11 is a flow diagram illustrating an example of a process for automatically identifying the key from data in a given digital music display file, according to aspects of the present inventions. In this example, the digital music file having the chord data is retrieved or input, as shown at block 250 (the file is in RTF format in this example). The chords of the file are then examined (such as can be achieved according to the above by examining the text of the lines of the file), and each chord is compared to a key chord table, as shown at block 252. Each key is associated with a set of chords. In this embodiment, each chord of the digital music display file is compared to the chords that make up each of the keys (from A to G including major and minor). For example, the algorithm can select the first chord of the text file and compare it to a stored table or file having the keys and the corresponding chords of each key. It is then determined, for each key, whether the chord at issue matches a chord in the key (as shown at the decision block 256). Each key can have a counter associated therewith (or an element of an array), and for each key Y, the counter Z can be incremented whenever a chord in the digital music file matches a chord of that key. This is shown at block 260. For a given key Y, if the chord at issue X does not match any chords in that key Y, then the process does nothing, and the counter Z(Y) is not incremented, as shown at block 258. In this embodiment of this aspect of the inventions, it is also determined whether the chord at issue X is a the first chord in the digital music display file. This process is shown at block 262. If so, and if that chord X matches a chord in a particular key, then the counter for that particular key Z(Y) is incremented an extra count, as shown at block 264. In other words, the first chord in the song is given extra weight in determining the key in this embodiment.

After all of the chords in the file have been analyzed, the key Y having the counter Z(Y) with the highest value is considered to be the key of the song. This can be determined by comparing the various counters Z(Y) of the keys Y. This determined key Y can then be displayed with the song or elsewhere.

Figure 12:
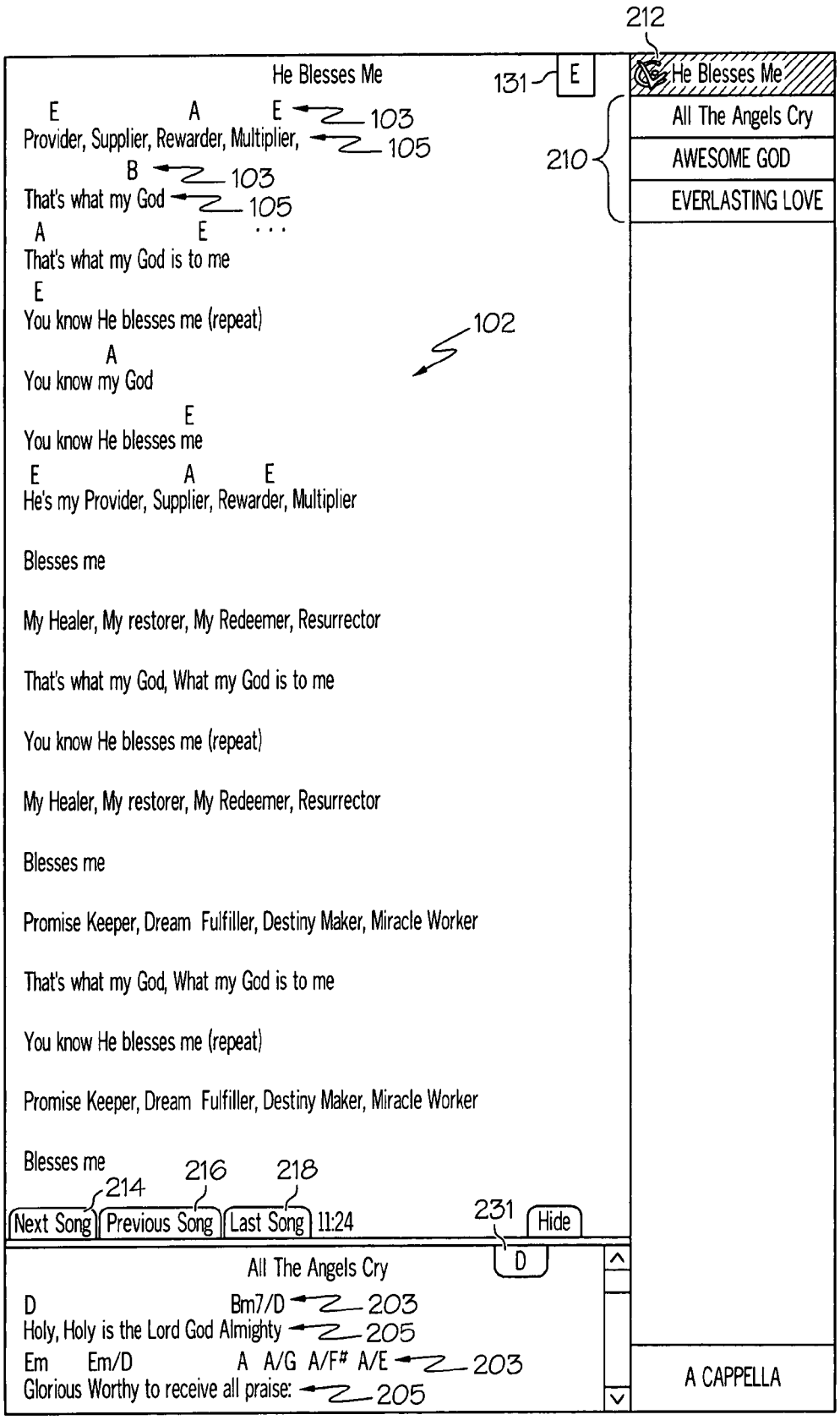
FIG. 12 is another an exemplary user interface for display of the contents of a music text file as it might appear on a computer screen, with ability to show the key of the song, according to additional aspects of the present inventions.

FIG. 12 depicts an exemplary user interface for display of the contents of a music text file, with ability to show the key of the song, according to aspects of the present inventions. In this embodiment, the textual representations of the lyrics 105 and chords 103 are shown adjacent to the key 131. The key 131 can be automatically detected based upon analysis of the chords 103, such as discussed above. (This automatic detection can occur when a song is first imported into the system, or when a song is pulled up in an editor, or upon a command by the user; the detected key can be then displayed with the song, as shown in FIG. 12. In some embodiments, the key can also be saved with the song data once detected.) In this embodiment, the current song 102 is shown at the top half of the screen, while the next song 202 to be performed is shown in the bottom half of the screen. The key 231 of the next song can also be displayed adjacent the first lines of the lyrics 205 and chords 203 of the next song 202. In this embodiment, a list 210 is utilized to display the songs being performed, with the current song being display in the top highlighted position 212. Any of these songs can be selected by clicking on the title of the song in the list 210. Additionally, controls 214, 216, and 218 can be utilized to move to the next song, the previous song, and the last song.

Figure 13:
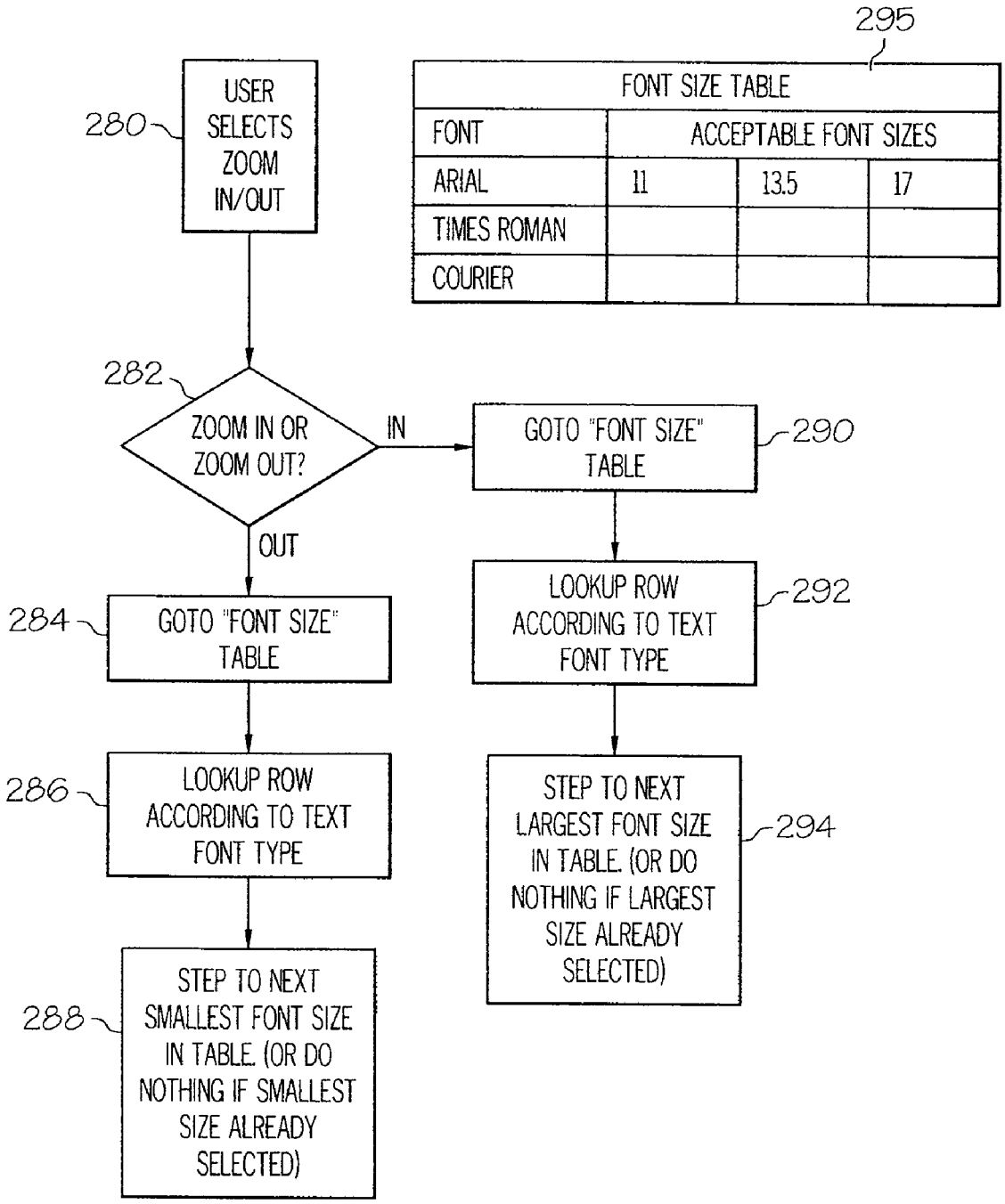
FIG. 13 is a flow diagram illustrating an example of a process for automatically modifying the font of lyrics and/or chords or notes of a given digital music display file, so as to provide for accurate display of the same, according to aspects of the present inventions.

FIG. 13 is a flow diagram illustrating an example of a process for automatically modifying the font of lyrics and/or chords or notes of a given digital music display file, so as to provide for accurate display of the same, according to aspects of the present inventions. In this example, the user is viewing a music display file and decides to change the appearance of the display by selecting a zoom in or zoom out command as shown at block 280 (e.g., by using buttons 141 or 143 of FIG. 10). If the command is to zoom out, the process proceeds to block 282, where a font size table 295, which can comprise stored data representing acceptable font sizes for the music lyrics and music notation (chords or notes). Based upon which font the lyrics and notations are in, the next acceptable size for that font is chosen. This is shown at block 286 where the process looks up the acceptable sizes in the row corresponding to the font type. For example, as shown in the example table 295, acceptable sizes for the Arial font might be 11, 13.5, or 17 (19.5 and 22 are additional examples). According to aspects of the present inventions, these sizes can be different for each font size, and not all potential sizes may be present in the table 295—certain sizes may cause the lyrics and the notations to be displayed erroneously such that the notations do not appear above the appropriate lyrics. Accordingly, the table 295 includes predetermined sizes that are appropriate to correctly display the lyrics and notations of files 102 and 202. As shown at block 288, the next smallest appropriate font size is selected from the table (relative to the current font size). Accordingly, if the font was Arial 13.5 and the user pressed the zoom out button, the Arial 11 font size would be selected and the lyrics and notations displayed in that size. If the smallest size is already the current size, then no further zooming is permitted (the current font size is not changed), as shown at block 288.

If the user has selected the zoom in command, then the font size table is accessed at block 290. The available font sizes for the current font are consulted and the next largest font size is selected from the stored data is selected. If there is no larger font size relative to the current size, then the current size is not changed, as shown at blocks 292 and 294. For example, with referenced to exemplary table 295 of FIG. 13, if the current font size is Arial 13.5, and the user selects zoom in, the Arial 17 is selected and the font of the lyrics and notations are changed to that font, to allow for a larger display of the text so as to provide a magnification (zooming in) effect of the music display file. FIGS. 14*a*-14*c* illustrate suitable and unsuitable font sizes according to such aspects of the inventions. The lyrics 105 and notations 103 of FIG. 14*a* are in the current font size of Arial 11. However, as shown in FIG. 14*b*, a zooming in effect cannot be carried out by choosing Arial 13, as this causes the notations 103 to be inaccurate relative to the lyrics 105. However, FIG. 14*c* shows that Arial 13.5 is appropriate for zooming in, as it still maintains the proper relationship between the notations 103 and the lyrics 105. Accordingly, Arial 13.5 would be appropriate for the list/table of appropriate Arial zoom in fonts in this example, but Arial 16 would not be. Table 295 can be developed using such analysis. The process of FIG. 13 thus produces minimized special error between two lines of text whose characters are intended to have a relative spacing to one another.

Figure 15:
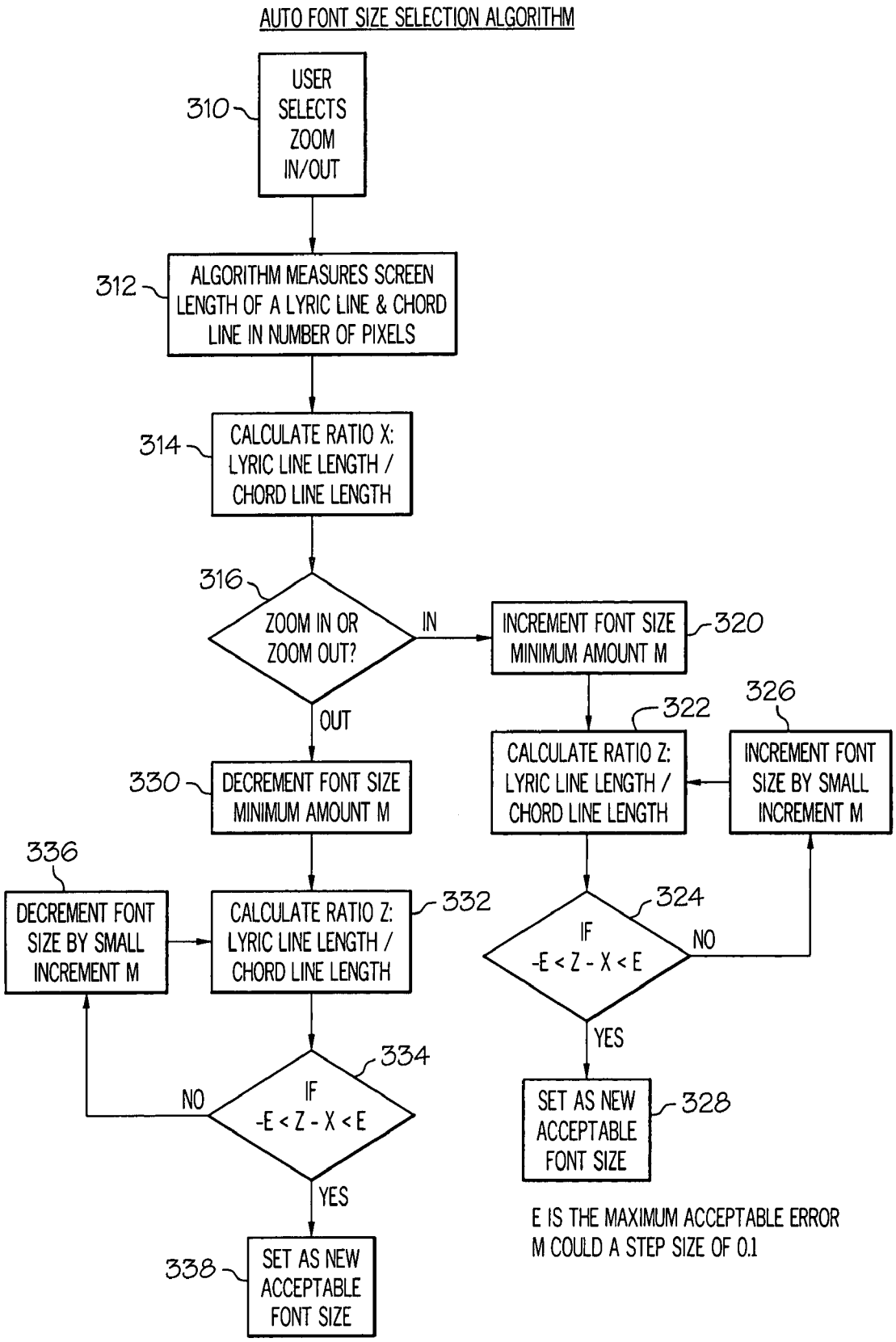
FIG. 15 is a flow diagram illustrating an example of an automatic font size selection method, operating according to some aspects of the present inventions.

FIG. 15 is a flow diagram illustrating an example of an automatic font size selection method, operating according to some additional aspects of the present inventions. As shown in this example, the user can select a zoom in or zoom out command, at block 310, causing a computer implemented algorithm (e.g., a program or instructions) to measure a screen length of a lyric line and chord line in a music display file (e.g., in pixel lengths) as shown at block 312. (FIG. 16 is an example of the measuring of a string of text and musical notation, according to additional aspects of the present inventions. Here a chord line and a text line from the file are selected, the data converted to data for display, and the number of pixels comprising that display data determined. Accordingly, the pixel length of the chord line and the pixel length of the lyric line are known.) A ratio X is then calculated of the lyric line length to the chord line length, as shown at block 314. Depending on whether the user selected zoom in or zoom out, the algorithm then tries differing incremental font sizes and determines whether the new line length to chord length ratio Z falls outside of a predetermined acceptable error E relative to the originally calculated ratio X. In particular, if it is determined that the user selected zoom in, then the font size of the chords and lyrics can be increased by a minimum incremental amount M, and the new ratio Z calculated, as shown at blocks 316, 320 and 322. It is then determined whether the absolute value of the difference between the new ratio Z and the prior ratio X is less than the permitted predetermined maximum acceptable error E, as shown at block 324. If not, then the font size is incremented again by the minimum amount M (e.g., by 0.1) and the ratio recalculated and compared to the permitted error, as shown at blocks 326, 322, and 324. Once a given incremented font size provides a ratio Z that is acceptable (the difference between it and X is less than E), then the method continues to block 328 and sets the lyrics and chords to that font size and displays the lyrics and chords in that font size, causing a zooming in effect.

Similarly, if the user selects a zoom out command, then the font size of the chords and text are decremented by the minimum amount M, as shown at blocks 316 and 330. A ratio Z of the new lyric and chord lines (in their new font sizes) is then calculated, similar to as described above, as shown at block 332. The difference of that new ratio Z to the original ratio X is then determined and compared to the permitted acceptable error E. If the difference exceeds the acceptable error E, then the font is again decremented and another ratio Z calculated for the new font, as shown at blocks 332, 336, and 332. Once the difference between X and Z for a given decremented font size is within the acceptable range (less than E), then that font is selected for the chord text and the line text, and the chord text and line text are displayed in that font, causing a zooming out effect, as shown at blocks 334 and 338.

The above methods and algorithms can be implemented in a variety of computer or electronic systems having one or more processors, controllers, or circuitry for execution of code, instructions, programs, software, firmware, and the like for carrying out the desired tasks. The methods and algorithms are especially useful in a music display system having multiple displays for members of a music group, such as one of the example systems described above, although the methods and algorithms can be operated using a variety of computer or electronic systems or devices.

The foregoing description of the various embodiments and principles of the inventions has been presented for the purposes of illustration and description. It is not intended to be exhaustive or to limit the inventions the precise forms disclosed. Many alternatives, modifications, and variations will be apparent to those skilled in the art. For example, some of the principles of the inventions may be utilized in different multi-display systems such as educational purposes, advertising, music groups, and the like. Moreover, although many inventive aspects have been presented, such aspects need not be utilized in combination, and various combinations of inventive aspects are possible in light of the various embodiments provided above. Accordingly, the above description is intended to embrace all possible alternatives, modifications, combinations, and variations, and have been discussed or suggested herein, as well as all others that fall within the principles, spirit, and broad scope of the various inventions as defined by the claims.

What is claimed is:

1. A system configured to display musical data, the system comprising:

a controller station configured to store a music display file in memory, wherein the music display file comprises text representing lyrics and text representing musical notation letters, wherein the musical display file includes an indication of the correspondence between each portion of musical notation letter text with each portion of lyric text;

a display configured to receive the music display file and to display each portion of musical notation text adjacent to the corresponding portion of musical letter text; and a set of stored instructions configured to be executed by a processor at the controller station and configured to cause the system to receive input commands for adjusting the zoom level of the displayed musical display text file, and configured to automatically adjust the fonts of the lyric text and the musical notation text to maintain appropriate relative display of the musical notation text and the lyric text.

2. The system as recited in claim 1, wherein the musical notation text is displayed with a first appearance and the musical letter text is stored with a second appearance.

3. The system as recited in claim 2, wherein the first and second appearances comprise differing colors.

4. The system as recited in claim 1, further comprising a set of stored instructions configured to be executed by a processor at the controller station and configured to analyze the musical display text file to determine which portions of the file are lyrics and which portions of the file are musical notation.

5. The system as recited in claim 1, further comprising a set of stored instructions configured to be executed by a processor at the controller station and configured to analyze the musical display text file to determine musical characteristics of the file.

6. The system as recited in claim 5, wherein the musical characteristics comprise the key of the musical notation, and wherein the controller station is configured to display the key adjacent the lyrics and the musical notation.

7. A method for detecting a musical characteristic of a music display file, comprising:

accessing a music display digital file, wherein the music display digital file includes data representing at least one of lyrics and musical notation to be visually displayed to a user;

analyzing sections of the data to determine a musical characteristic of the music display digital file, wherein a musical characteristic comprises the key of musical notation in the music display digital file, and wherein the key is displayed and wherein musical notation of the music display digital file is displayed adjacent lyrics of the music display digital file, the determination being made by comparing data of the file representing musical notation with a set of predetermined data comprising notation corresponding to each key and incrementing a counter for each key based upon the number of matches of data in the file with notation for the key; and storing the musical characteristic.

8. The method as recited in claim 7, further comprising displaying the musical characteristic along with at least one of lyrics and musical notation.

9. The method as recited in claim 7, wherein the counter is incremented additionally if the match is for the first notation in the file.

10. A method for changing the display appearance of a music display file, comprising:

receiving a command to change the display of music display data wherein the command comprises a zoom command;

determining an appropriate display appearance for the music display data based upon the command received, wherein the display appearance comprises a font, and wherein the determination comprises determining an appropriate display appearance for musical lyrics and musical notations based upon the command by using stored appearance characteristics suitable for the lyrics and notations and the command received;

displaying the music display data in the appropriate display appearance.

11. The method as recited in claim 10, wherein the stored appearance characteristics comprise predetermined font levels for the lyrics and the notations allowing for proper display of the notations relative to the lyrics.

12. The method as recited in claim 10, wherein the music display data comprises a line of lyric text and a line of musical notation text, wherein the determining step comprises calculating a relation between the length of the lyric line to the length of the musical notation line, modifying the font size of the lyrics and musical notations, calculating a new relation between the length of the modified lyric line to the length of the modified notation line, and determining whether the new relation is acceptable.

* * * * *